US006239348B1

(12) United States Patent
Metcalf

(10) Patent No.: US 6,239,348 B1
(45) Date of Patent: May 29, 2001

(54) SOUND SYSTEM AND METHOD FOR CREATING A SOUND EVENT BASED ON A MODELED SOUND FIELD

(76) Inventor: Randall B. Metcalf, 2006 Hamilton Crossing Dr., Cantonment, FL (US) 32553

( * ) Notice: Subject to any disclaimer, the term of this patent is extended or adjusted under 35 U.S.C. 154(b) by 0 days.

(21) Appl. No.: 09/393,324

(22) Filed: Sep. 10, 1999

(51) Int. Cl.[7] ..... G10H 3/00; H04R 5/00

(52) U.S. Cl. ..... 84/723; 84/737; 84/DIG. 27; 381/26; 381/307

(58) Field of Search ..... 84/600–601, 626, 84/629–630, 723–726, 730–731, 737–740, 743, DIG. 1, DIG. 26, DIG. 27; 381/17, 26, 122, 307, 82, 85, 89, 304, 305, 91, 92

(56) References Cited

U.S. PATENT DOCUMENTS 4,393,270 * 7/1983 Van Den Berg ..... 381/17
4,675,906 * 6/1987 Sessler et al. ..... 381/92
5,657,393 * 8/1997 Crow ..... 381/92
5,850,455 * 12/1998 Arnold et al. ..... 381/17

* cited by examiner

*Primary Examiner*—Robert E. Nappi
*Assistant Examiner*—Marlon Fletcher
(74) *Attorney, Agent, or Firm*—Hunton & Williams

(57) ABSTRACT

A sound system and method for modeling a sound field generated by a sound source and creating a sound event based on the modeled sound field is disclosed. The system and method captures a sound field over an enclosing surface, models the sound field and enables reproduction of the modeled sound field. Explosion type acoustical radiation may be used. Further, the reproduced sound field may be modeled and compared to the original sound field model.

24 Claims, 3 Drawing Sheets

SOUND SYSTEM AND METHOD FOR CREATING A SOUND EVENT BASED ON A MODELED SOUND FIELD

The invention relates generally to sound field modeling and creation of a sound event based on a modeled sound field, and more particularly to a method and apparatus for capturing a sound field with a plurality of sound capture devices located on an enclosing surface, modeling and storing the sound field and subsequently creating a sound event based on the stored information.

BACKGROUND OF THE INVENTION

Existing sound recording systems typically use two or three microphones to capture sound events produced by a sound source, e.g., a musical instrument. The captured sounds can be stored and subsequently played back. However, various drawbacks exist with these types of systems. These drawbacks include the inability to capture accurately three dimensional information concerning the sound and spatial variations within the sound (including full spectrum "directivity patterns"). This leads to an inability to accurately produce or reproduce sound based on the original sound event. A directivity pattern is the resultant sound field radiated by a sound source (or distribution of sound sources) as a function of frequency and observation position around the source (or source distribution). The possible variations in pressure amplitude and phase as the observation position is changed are due to the fact that different field values can result from the superposition of the contributions from all elementary sound sources at the field points. This is correspondingly due to the relative propagation distances to the observation location from each elementary source location, the wavelengths or frequencies of oscillation, and the relative amplitudes and phases of these elementary sources. It is the principle of superposition that gives rise to the radiation patterns characteristics of various vibrating bodies or source distributions. Since existing recording systems do not capture this 3-D information, this leads to an inability to accurately model, produce or reproduce 3-D sound radiation based on the original sound event.

On the playback side, prior systems typically use "Implosion Type" (IMT) sound fields. That is, they use two or more directional channels to create a "perimeter effect" sound field. The basic IMT method is "stereo," where a left and a right channel are used to attempt to create a spatial separation of sounds. More advanced IMT methods include surround sound technologies, some providing as many as five directional channels (left, center, right, rear left, rear right), which creates a more engulfing sound field than stereo. However, both are considered perimeter systems and fail to fully recreate original sounds. Perimeter systems typically depend on the listener being in a stationary position for maximum effect. Implosion techniques are not well suited for reproducing sounds that are essentially a point source, such as stationary sound sources (e.g., musical instruments, human voice, animal voice, etc.) that radiate sound in all or many directions.

Other drawbacks and disadvantages of the prior art also exist.

SUMMARY OF THE INVENTION

An object of the present invention is to overcome these and other drawbacks of the prior art.

Another object of the present invention is to provide a system and method for capturing a sound field, which is produced by a sound source over an enclosing surface (e.g., approximately a 360° spherical surface), and modeling the sound field based on predetermined parameters (e.g, the pressure and directivity of the sound field over the enclosing space over time), and storing the modeled sound field to enable the subsequent creation of a sound event that is substantially the same as, or a purposefully modified version of, the modeled sound field.

Another object of the present invention is to model the sound from a sound source by detecting its sound field over an enclosing surface as the sound radiates outwardly from the sound source, and to create a sound event based on the modeled sound field, where the created sound event is produced using an array of loud speakers configured to produce an "explosion" type acoustical radiation. Preferably, loudspeaker clusters are in a 360° (or some portion thereof) cluster of adjacent loudspeaker panels, each panel comprising one or more loudspeakers facing outward from a common point of the cluster. Preferably, the cluster is configured in accordance with the transducer configuration used during the capture process and/or the shape of the sound source.

According to one object of the invention, an explosion type acoustical radiation is used to create a sound event that is more similar to naturally produced sounds as compared with "implosion" type acoustical radiation. Natural sounds tend to originate from a point in space and then radiate up to 360° from that point.

According to one aspect of the invention, acoustical data from a sound source is captured by a 360° (or some portion thereof) array of transducers to capture and model the sound field produced by the sound source. If a given soundfield is comprised of a plurality of sound sources, it is preferable that each individual sound source be captured and modeled separately.

A playback system comprising an array of loudspeakers or loudspeaker systems recreates the original sound field. Preferably, the loudspeakers are configured to project sound outwardly from a spherical (or other shaped) cluster. Preferably, the soundfield from each individual sound source is played back by an independent loudspeaker cluster radiating sound in 360° (or some portion thereof). Each of the plurality of loudspeaker clusters, representing one of the plurality of original sound sources, can be played back simultaneously according to the specifications of the original soundfields produced by the original sound sources. Using this method, a composite soundfield becomes the sum of the individual sound sources within the soundfield.

To create a near perfect representation of the soundfield, each of the plurality of loudspeaker clusters representing each of the plurality of original sound sources should be located in accordance with the relative location of the plurality of original sound sources. Although this is a preferred method for EXT reproduction, other approaches may be used. For example, a composite soundfield with a plurality of sound sources can be captured by a single capture apparatus (360° spherical array of transducers or other geometric configuration encompassing the entire composite soundfield) and played back via a single EXT loudspeaker cluster (360° or any desired variation). However, when a plurality of sound sources in a given soundfield are captured together and played back together (sharing an EXT loudspeaker cluster), the ability to individually control each of the independent sound sources within the soundfield is restricted. Grouping sound sources together also inhibits the ability to precisely "locate" the position of each individual sound source in accordance with the relative position of the original sound sources. However, there are circumstances which are favorable to grouping sound sources together. For instance, during a musical production with many musical instruments involved (i.e., full orchestra). In this case it would be desirable, but not necessary, to group sound sources together based on some common characteristic (e.g, strings, woodwinds, horns, keyboards, percussion, etc.).

These and other objects of the invention are accomplished according to one embodiment of the present invention by defining an enclosing surface (spherical or other geometric configuration) around one or more sound sources, generating a sound field from the sound source, capturing predetermined parameters of the generated sound field by using an array of transducers spaced at predetermined locations over the enclosing surface, modeling the sound field based on the captured parameters and the known location of the transducers and storing the modeled sound field. Subsequently, the stored sound field can be used selectively to create sound events based on the modeled sound field. According to one embodiment, the created sound event can be substantially the same as the modeled sound event. According to another embodiment, one or more parameters of the modeled sound event may be selectively modified. Preferably, the created sound event is generated by using an explosion type loudspeaker configuration. Each of the loudspeakers may be independently driven to reproduce the overall soundfield on the enclosing surface.

Other embodiments, features and objects of the invention will be readily apparent in view of the detailed description of the invention presented below.

DETAILED DESCRIPTION OF THE PREFERRED EMBODIMENTS

Figure 1:
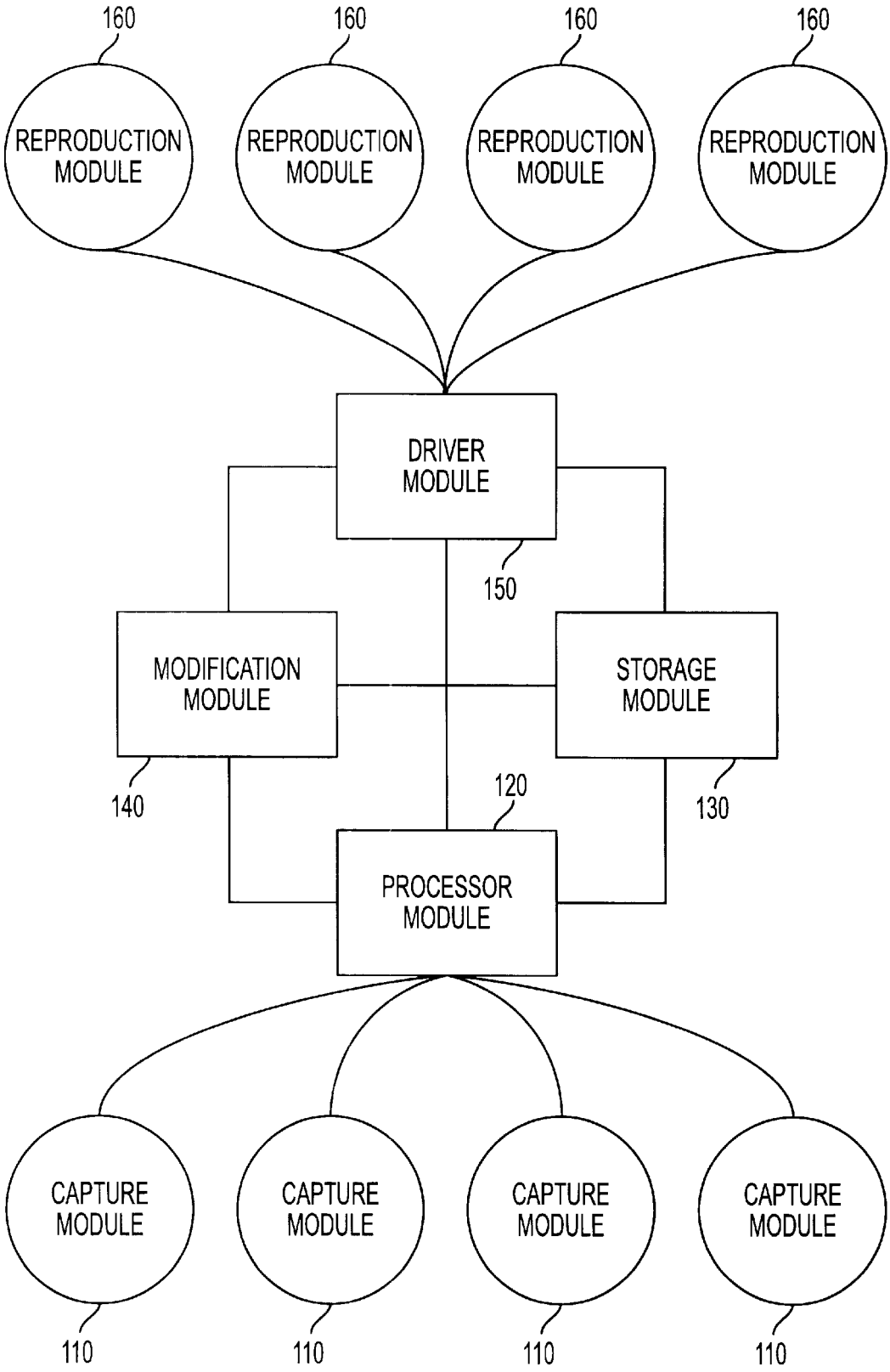
FIG. 1 is a schematic of a system according to an embodiment of the present invention.

FIG. 1 illustrates a system according to an embodiment of the invention. Capture module 110 may enclose sound sources and capture a resultant sound. According to an embodiment of the invention, capture module 110 may comprise a plurality of enclosing surfaces $\Gamma_a$, with each enclosing surface $\Gamma_a$ associated with a sound source. Sounds may be sent from capture module 110 to processor module 120. According to an embodiment of the invention, processor module 120 may be a central processing unit (CPU) or other type of processor. Processor module 120 may perform various processing functions, including modeling sound received from capture module 110 based on predetermined parameters (e.g amplitude, frequency, direction, formation, time, etc.). Processor module 120 may direct information to storage module 130. Storage module 130 may store information, including modeled sound. Modification module 140 may permit captured sound to be modified. Modification may include modifying volume, amplitude, directionality, and other parameters. Driver module 150 may instruct reproduction modules 160 to produce sounds according to a model. According to an embodiment of the invention, reproduction module 160 may be a plurality of amplification devices and loudspeaker clusters, with each loudspeaker cluster associated with a sound source. Other configurations may also be used. The components of FIG. 1 will now be described in more detail.

Figure 2:
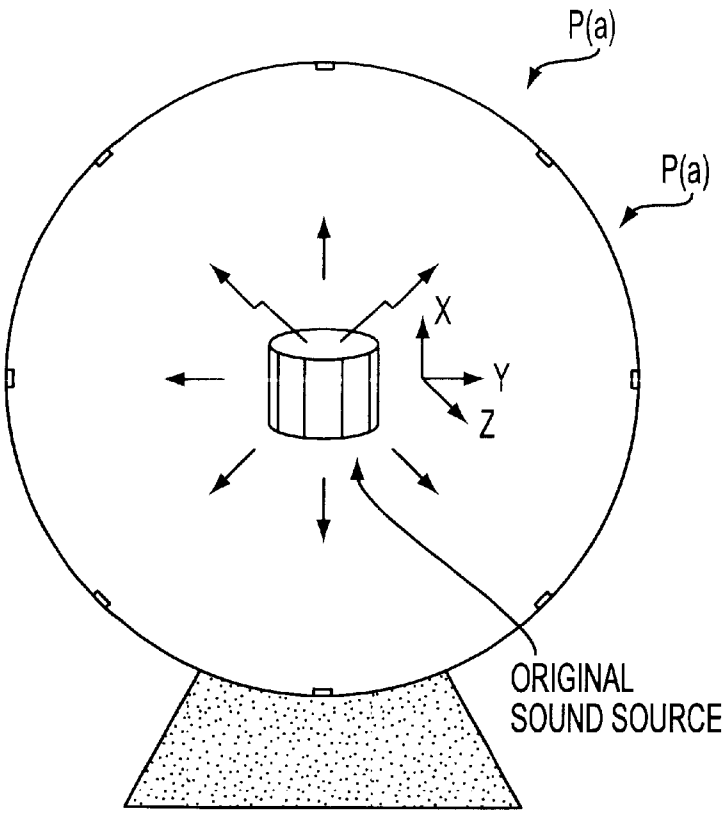
FIG. 2 is a perspective view of a capture module for capturing sound according to an embodiment of the present invention.

FIG. 2 depicts a capture module 110 for implementing an embodiment of the invention. As shown in the embodiment of FIG. 2, one aspect of the invention comprises at least one sound source located within an enclosing (or partially enclosing) surface $\Gamma_a$, which for convenience is shown to be a sphere. Other geometrically shaped enclosing surface $\Gamma_a$ configurations may also be used. A plurality of transducers are located on the enclosing surface $\Gamma_a$ at predetermined locations. The transducers are preferably arranged at known locations according to a predetermined spatial configuration to permit parameters of a sound field produced by the sound source to be captured. More specifically, when the sound source creates a sound field, that sound field radiates outwardly from the source over substantially 360°. However, the amplitude of the sound will generally vary as a function of various parameters, including perspective angle, frequency and other parameters. That is to say that at very low frequencies (~20 Hz), the radiated sound amplitude from a source such as a speaker or a musical instrument is fairly independent of perspective angle (omnidirectional). As the frequency is increased, different directivity patterns will evolve, until at very high frequency (~20 kHz), the sources are very highly directional. At these high frequencies, a typical speaker has a single, narrow lobe of highly directional radiation centered over the face of the speaker, and radiates minimally in the other perspective angles. The sound field can be modeled at an enclosing surface $\Gamma_a$ by determining various sound parameters at various locations on the enclosing surface $\Gamma_a$. These parameters may include, for example, the amplitude (pressure), the direction of the sound field at a plurality of known points over the enclosing surface and other parameters.

According to one embodiment of the present invention, when a sound field is produced by a sound source, the plurality of transducers measures predetermined parameters of the sound field at predetermined locations on the enclosing surface over time. As detailed below, the predetermined parameters are used to model the sound field.

Figure 3:
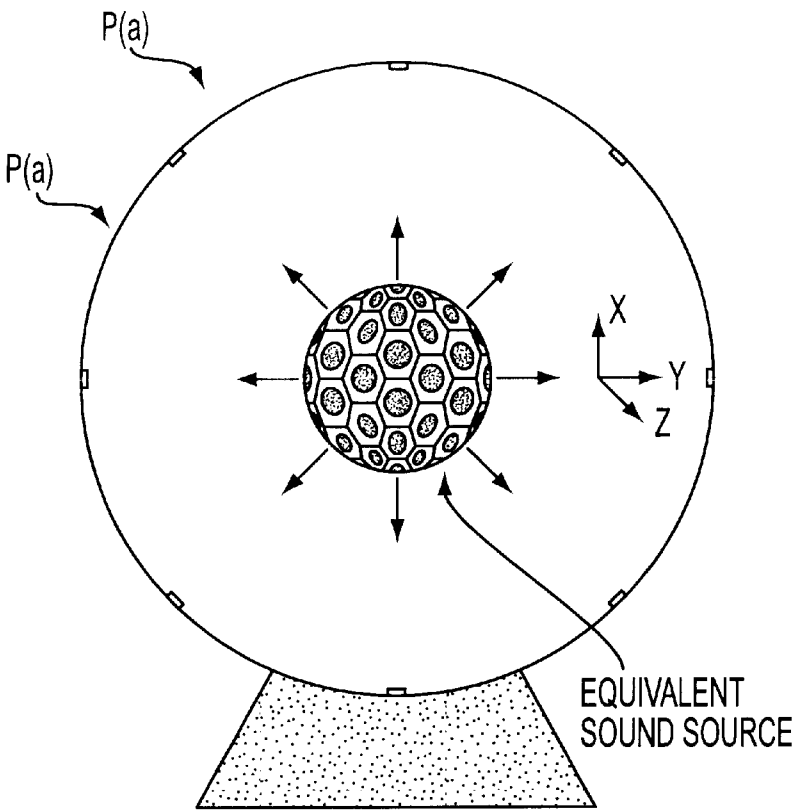
FIG. 3 is a perspective view of a reproduction module according to an embodiment of the present invention.

For example, assume a spherical enclosing surface $\Gamma_a$ with N transducers located on the enclosing surface $\Gamma_a$. Further consider a radiating sound source surrounded by the enclosing surface, $\Gamma_a$ (FIG. 2). The acoustic pressure on the enclosing surface $\Gamma_a$ due to a soundfield generated by the sound source will be labeled P(a). It is an object to model the sound field so that the sound source can be replaced by an equivalent source distribution such that anywhere outside the enclosing surface $\Gamma_a$, the sound field, due to a sound event generated by the equivalent source distribution, will be substantially identical to the sound field generated by the actual sound source (FIG. 3). This can be accomplished by reproducing acoustic pressure P(a) on enclosing surface $\Gamma_a$ with sufficient spatial resolution. If the sound field is reconstructed on enclosing surface $\Gamma_a$, in this fashion, it will continue to propagate outside this surface in its original manner.

While various types of transducers may be used for sound capture, any suitable device that converts acoustical data (e.g., pressure, frequency, etc.) into electrical, or optical data, or other usable data format for storing, retrieving, and transmitting acoustical data" may be used.

Processor module 120 may be central processing unit (CPU) or other processor. Processor module 120 may perform various processing functions, including modeling sound received from capture module 110 based on predetermined parameters (e.g. amplitude, frequency, direction, formation, time, etc.), directing information, and other processing functions. Processor module 120 may direct information between various other modules within a system, such as directing information to one or more of storage module 130, modification module 140, or driver module 150.

Storage module 130 may store information, including modeled sound. According to an embodiment of the invention, storage module may store a model, thereby allowing the model to be recalled and sent to modification module 140 for modification, or sent to driver module 150 to have the model reproduced.

Modification module 140 may permit captured sound to be modified. Modification may include modifying volume, amplitude, directionality, and other parameters. While various aspects of the invention enable creation of sound that is substantially identical to an original sound field, purposeful modification may be desired. Actual sound field models can be modified, manipulated, etc. for various reasons including customized designs, acoustical compensation factors, amplitude extension, macro/micro projections, and other reasons. Modification module 140 may be software on a computer, a control board, or other devices for modifying a model.

Driver module 150 may instruct reproduction modules 160 to produce sounds according to a model. Driver module 150 may provide signals to control the output at reproduction modules 160. Signals may control various parameters of reproduction module 160, including amplitude, directivity, and other parameters. FIG. 3 depicts a reproduction module 160 for implementing an embodiment of the invention. According to an embodiment of the invention, reproduction module 160 may be a plurality of amplification devices and loudspeaker clusters, with each loudspeaker cluster associated with a sound source.

Preferably there are N transducers located over the enclosing surface $\Gamma_a$ of the sphere for capturing the original sound field and a corresponding number N of transducers for reconstructing the original sound field. According to an embodiment of the invention, there may be more or less transducers for reconstruction as compared to transducers for capturing. Other configurations may be used in accordance with the teachings of the present invention.

Figure 4:
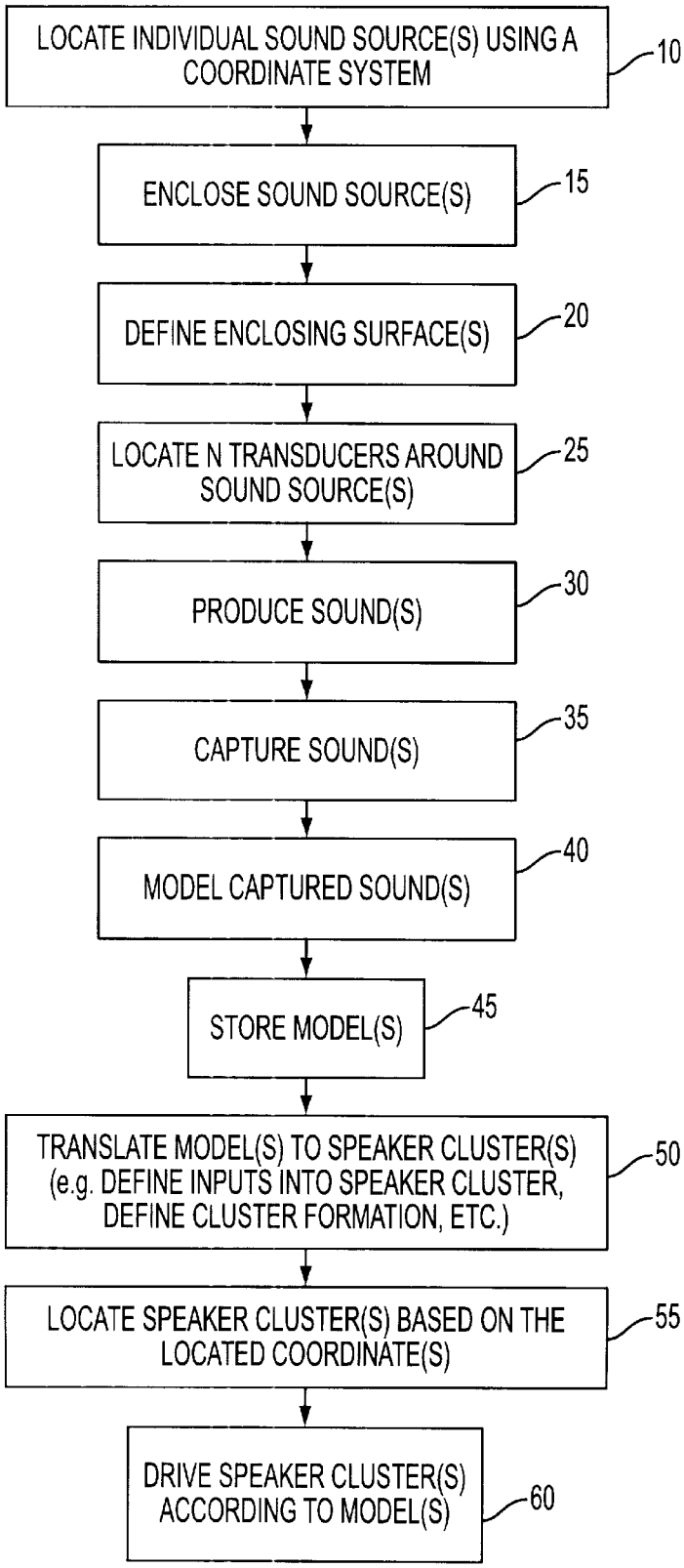
FIG. 4 is a flow chart illustrating operation of a sound field representation and reproduction system according to the embodiment of the present invention.

FIG. 4 illustrates a flow-chart according to an embodiment of the invention wherein a number of sound sources are captured and recreated. Individual sound source(s) may be located using a coordinate system at step 10. Sound source (s) may be enclosed at step 15, enclosing surface $\Gamma_a$ may be defined at step 20, and N transducers may be located around enclosed sound source(s) at step 25. According to an embodiment of the invention, as illustrated in FIG. 2, transducers may be located on the enclosing surface $\Gamma_a$. Sound(s) may be produced at step 30, and sound(s) may be captured by transducers at step 35. Captured sound(s) may be modeled at step 40, and model(s) may be stored at step 45. Model(s) may be translated to speaker cluster(s) at step 50. At step 55, speaker cluster(s) may be located based on located coordinate(s). According to an embodiment of the invention, translating a model may comprise defining inputs into a speaker cluster. At step 60, speaker cluster(s) may be driven according to each model, thereby producing a sound. Sound sources may be captured and recreated individually (e.g. each sound source in a band is individually modeled) or in groups. Other methods for implementing the invention may also be used.

According to an embodiment of the invention, as illustrated in FIG. 2, sound from a sound source may have components in three dimensions. These components may be measured and adjusted to modify directionality. For this reproduction system, it is desired to reproduce the directionality aspects of a musical instrument, for example, such that when the equivalent source distribution is radiated within some arbitrary enclosure, it will sound just like the original musical instrument playing in this new enclosure. This is different from reproducing what the instrument would sound like if one were in fifth row center in Carnegie Hall within this new enclosure. Both can be done, but the approaches are different. For example, in the case of the Carnegie Hall situation, the original sound event contains not only the original instrument, but also its convolution with the concert hall impulse response. This means that at the listener location, there is the direct field (or outgoing field) from the instrument plus the reflections of the instrument off the walls of the hall, coming from possibly all directions over time. To reproduce this event within a playback environment, the response of the playback environment should be canceled through proper phasing, such that substantially only the original sound event remains. However, we would need to fit a volume with the inversion, since the reproduced field will not propagate as a standing wave field which is characteristic of the original sound event (i.e., waves going in many directions at once). If, however, it is desired to reproduce the original instrument's radiation pattern without the reverberatory effects of the concert hall, then the field will be made up of outgoing waves (from the source), and one can fit the outgoing field over the surface of a sphere surrounding the original instrument. By obtaining the inputs to the array for this case, the field will propagate within the playback environment as if the original instrument were actually playing in the playback room.

So, the two cases are as follows:

1. To reproduce the Carnegie Hall event, one needs to know the total reverberatory sound field within a volume, and fit that field with the array subject to spatial Nyquist convergence criteria. There would be no guarantee however that the field would converge anywhere outside this volume.

2. To reproduce the original instrument alone, one needs to know the outgoing (or propagating) field only over a circumscribing sphere, and fit that field with the array subject to convergence criteria on the sphere surface. If this field is fit with sufficient convergence, the field will continue to propagate within the playback environment as if the original instrument were actually playing within this volume.

Thus, in one case, an outgoing sound field on enclosing surface $\Gamma_a$ has either been obtained in an anechoic environment or reverberatory effects of a bounding medium have been removed from the acoustic pressure P(a). This may be done by separating the sound field into its outgoing and incoming components. This may be performed by measuring the sound event, for example, within an anechoic environment, or by removing the reverberatory effects of the recording environment in a known manner. For example, the reverberatory effects can be removed in a known manner using techniques from spherical holography. For example, this requires the measurement of the surface pressure and velocity on two concentric spherical surfaces. This will permit a formal decomposition of the fields using spherical harmonics, and a determination of the outgoing and incoming components comprising the reverberatory field. In this event, we can replace the original source with an equivalent distribution of sources within enclosing surface $\Gamma_a$. Other methods may also be used.

By introducing a function $H_{ij}(\omega)$, and defining it as the transfer function between source point "i" (of the equivalent source distribution) to field point "j" (on the enclosing surface $\Gamma_a$), and denoting the column vector of inputs to the sources $\chi_i(\omega)$, i=1, 2 . . . N, as X, the column vector of acoustic pressures $P(a)_j$ j=1, 2, . . . N, on enclosing surface $\Gamma_a$ as P, and the N×N transfer function matrix as H, then a solution for the independent inputs required for the equivalent source distribution to reproduce the acoustic pressure P(a) on enclosing surface $\Gamma_a$ may be expressed as follows $$X=H^{-1}P. \quad \text{(Eqn. 1)}$$

Given a knowledge of the acoustic pressure P(a) on the enclosing surface $\Gamma_a$, and a knowledge of the transfer function matrix (H), a solution for the inputs X may be obtained from Eqn. (1), subject to the condition that the matrix $H^{-1}$ is nonsingular.

The spatial distribution of the equivalent source distribution may be a volumetric array of sound sources, or the array may be placed on the surface of a spherical structure, for example, but is not so limited. Determining factors for the relative distribution of the source distribution in relation to the enclosing surface $\Gamma_a$ may include that they lie within enclosing surface $\Gamma_a$, that the inversion of the transfer function matrix, $H^{-1}$, is nonsingular over the entire frequency range of interest, or other factors. The behavior of this inversion is connected with the spatial situation and frequency response of the sources through the appropriate Green's Function in a straightforward manner.

The equivalent source distributions may comprise one or more of:

a) piezoceramic transducers, b) Polyvinyldine Flouride (PVDF) actuators, c) Mylar sheets, d) vibrating panels with specific modal distributions, e) standard electroacoustic transducers, with various responses, including frequency, amplitude, and other responses, sufficient for the specific requirements (e.g., over a frequency range from about 20 Hz to about 20 kHz.

Concerning the spatial sampling criteria in the measurement of acoustic pressure P(a) on the enclosing surface $\Gamma_a$, from Nyquist sampling criteria, a minimum requirement may be that a spatial sample be taken at least one half the highest wavelength of interest. For 20 kHz in air, this requires a spatial sample to be taken every 8 mm. For a spherical enclosing $\Gamma_a$ surface of radius 2 meters, this results in approximately 683,600 sample locations over the entire surface. More or less may also be used.

Concerning the number of sources in the equivalent source distribution for the reproduction of acoustic pressure P(a), it is seen from Eqn. (1) that as many sources may be required as there are measurement locations on enclosing surface $\Gamma_a$. According to an embodiment of the invention, there may be more or less sources when compared to measurement locations. Other embodiments may also be used.

Concerning the directivity and amplitude variational capabilities of the array, it is an object of this invention to allow for increasing amplitude while maintaining the same spatial directivity characteristics of a lower amplitude response. This may be accomplished in the manner of solution as demonstrated in Eqn. 1, wherein now we multiply the matrix P by the desired scalar amplitude factor, while maintaining the original, relative amplitudes of acoustic pressure P(a) on enclosing surface $\Gamma_a$.

It is another object of this invention to vary the spatial directivity characteristics from the actual directivity pattern. This may be accomplished in a straightforward manner as in beam forming methods.

According to another aspect of the invention, the stored model of the sound field may be selectively recalled to create a sound event that is substantially the same as, or a purposely modified version of, the modeled and stored sound. As shown in FIG. 3, for example, the created sound event may be implemented by defining a predetermined geometrical surface (e.g., a spherical surface) and locating an array of loudspeakers over the geometrical surface. The loudspeakers are preferably driven by a plurality of independent inputs in a manner to cause a sound field of the created sound event to have desired parameters at an enclosing surface (for example a spherical surface) that encloses (or partially encloses) the loudspeaker array. In this way, the modeled sound field can be recreated with the same or similar parameters (e.g., amplitude and directivity pattern) over an enclosing surface. Preferably, the created sound event is produced using an explosion type sound source, i.e., the sound radiates outwardly from the plurality of loudspeakers over 360° or some portion thereof.

One advantage of the present invention is that once a sound source has been modeled for a plurality of sounds and a sound library has been established, the sound reproduction equipment can be located where the sound source used to be to avoid the need for the sound source, or to duplicate the sound source, synthetically as many times as desired.

The present invention takes into consideration the magnitude and direction of an original sound field over a spherical, or other surface, surrounding the original sound source. A synthetic sound source (for example, an inner spherical speaker cluster) can then reproduce the precise magnitude and direction of the original sound source at each of the individual transducer locations. The integral of all of the transducer locations (or segments) mathematically equates to a continuous function which can then determine the magnitude and direction at any point along the surface, not just the points at which the transducers are located.

According to another embodiment of the invention, the accuracy of a reconstructed sound field can be objectively determined by capturing and modeling the synthetic sound event using the same capture apparatus configuration and process as used to capture the original sound event. The synthetic sound source model can then be juxtaposed with the original sound source model to determine the precise differentials between the two models. The accuracy of the sonic reproduction can be expressed as a function of the differential measurements between the synthetic sound source model and the original sound source model. According to an embodiment of the invention, comparison of an original sound event model and a created sound event model may be performed using processor module 120.

Alternatively, the synthetic sound source can be manipulated in a variety of ways to alter the original sound field. For example, the sound projected from the synthetic sound source can be rotated with respect to the original sound field without physically moving the spherical speaker cluster. Additionally, the volume output of the synthetic source can be increased beyond the natural volume output levels of the original sound source. Additionally, the sound projected from the synthetic sound source can be narrowed or broadened by changing the algorithms of the individually powered loudspeakers within the spherical network of loudspeakers. Various other alterations or modifications of the sound source can be implemented.

By considering the original sound source to be a point source within an enclosing surface $\Gamma_a$, simple processing can be performed to model and reproduce the sound.

According to an embodiment, the sound capture occurs in an anechoic chamber or an open air environment with support structures for mounting the encompassing transducers. However, if other sound capture environments are used, known signal processing techniques can be applied to compensate for room effects. However, with larger numbers of transducers, the "compensating algorithms" can be somewhat more complex.

Once the playback system is designed based on given criteria, it can, from that point forward, be modified for various purposes, including compensation for acoustical deficiencies within the playback venue, personal preferences, macro/micro projections, and other purposes. An example of macro/micro projection is designing a synthetic sound source for various venue sizes. For example, a macro projection may be applicable when designing a synthetic sound source for an outdoor amphitheater. A micro projection may be applicable for an automobile venue. Amplitude extension is another example of macro/micro projection. This may be applicable when designing a synthetic sound source to perform 10 or 20 times the amplitude (loudness) of the original sound source. Additional purposes for modification may be narrowing or broadening the beam of projected sound (i.e., 360° reduced to 180°, etc.), altering the volume, pitch, or tone to interact more efficiently with the other individual sound sources within the same soundfield, or other purposes.

The present invention takes into consideration the "directivity characteristics" of a given sound source to be synthesized. Since different sound sources (e.g., musical instruments) have different directivity patterns the enclosing surface and/or speaker configurations for a given sound source can be tailored to that particular sound source. For example, horns are very directional and therefore require much more directivity resolution (smaller speakers spaced closer together throughout the outer surface of a portion of a sphere, or other geometric configuration), while percussion instruments are much less directional and therefore require less directivity resolution (larger speakers spaced further apart over the surface of a portion of a sphere, or other geometric configuration).

According to another embodiment of the invention, a computer usable medium having computer readable program code embodied therein for an electronic competition may be provided. For example, the computer usable medium may comprise a CD ROM, a floppy disk, a hard disk, or any other computer usable medium. One or more of the modules of system 100 may comprise computer readable program code that is provided on the computer usable medium such that when the computer usable medium is installed on a computer system, those modules cause the computer system to perform the functions described.

According to one embodiment, processor module 120, storage module 130, modification module 140, and driver module 150 may comprise computer readable code that, when installed on a computer, perform the functions described above. Also, only some of the modules may be provided in computer readable code.

According to one specific embodiment of the present invention, a system may comprise components of a software system. The system may operate on a network and may be connected to other systems sharing a common database. According to an embodiment of the invention, multiple analog systems (e.g. cassette tapes) may operate in parallel to each other to accomplish the objections and functions of the invention. Other hardware arrangements may also be provided.

Other embodiments, uses and advantages of the present invention will be apparent to those skilled in the art from consideration of the specification and practice of the invention disclosed herein. The specification and examples should be considered exemplary only. The intended scope of the invention is only limited by the claims appended hereto.

I claim:

1. A system for modeling a sound field comprising:

a sound source for producing a sound event that generates a radiating sound field;

a plurality of transducers arranged on a predetermined geometric surface at least partially surrounding said sound source to capture on the geometric surface the sound field generated by the sound event, where the sound field comprises predetermined parameters;

means for modeling the sound field based on at least selected ones of the predetermined parameters; and means for storing the modeled sound field.

2. The system of claim 1 wherein the predetermined geometric surface is a spherical surface and the plurality of transducers are located on the spherical surface.

3. The system of claim 1 wherein the predetermined parameters comprise amplitude and directivity, and the sound field is modeled based on at least the amplitude and directivity of the sound field at the predetermined geometric surface.

4. The system of claim 1 wherein the sound source is a musical instrument.

5. A system for modeling a sound field and creating a sound event based on the modeled sound field, said system comprising:

a sound source for producing a sound event that generates a radiating sound field;

a plurality of transducers arranged on a predetermined geometric surface at least partially surrounding said sound source to capture on the geometric surface a sound field generated by the sound event, where the sound field comprises predetermined parameters;

means for modeling the sound field based on at least selected ones of the predetermined parameters;

means for storing the modeled sound field; and means for selectively creating a sound event based on the modeled sound field.

6. The system of claim 5 wherein the predetermined geometric surface is a spherical surface and the plurality of transducers are located on the spherical surface.

7. The system of claim 5 wherein the predetermined parameters comprise amplitude and directivity, and the sound field is modeled based on at least the amplitude and directivity of the sound field at the predetermined geometric surface.

8. The system of claim 5 wherein the sound source is a musical instrument.

9. The system of claim 5 wherein the created sound event is a substantially identical replica of the sound event that generated the modeled sound field.

10. The system of claim 5 wherein the created sound event is based on the sound event that generated the modeled sound field, but is a purposefully modified version thereof.

11. The system of claim 5 wherein the created sound event is an explosion sound event.

12. The system of claim 5 further comprising:

means for modeling the created sound event; and means for comparing the original sound event model and the created sound event model.

13. A method for modeling a sound field generated by a sound source, said method comprising the steps of:

producing a sound event that generates a radiating sound field;

activating a plurality of transducers arranged on a predetermined geometric surface at least partially surrounding said sound source to capture on the geometric surface the sound field generated by the sound event, where the sound field comprises predetermined parameters;

modeling the sound field based on at least selected ones of the predetermined parameters; and storing the modeled sound field.

14. The method of claim 13 wherein the predetermined geometric surface is a spherical surface and the plurality of transducers are located on the spherical surface.

15. The method of claim 13 wherein the predetermined parameters comprise amplitude and directivity, and wherein the step of modeling the sound field is based on at least the amplitude and directivity of the sound field at the predetermined geometric surface.

16. The method of claim 13 wherein the sound source is a musical instrument.

17. A method for modeling a sound field generated by a sound source and creating a sound event based on the modeled sound field, said method comprising the steps of:

producing a sound event that generates a radiating sound field;

providing a plurality of transducers arranged on a predetermined geometric surface at least partially surrounding said sound source to capture on the geometric surface the sound field generated by the sound event, where the sound field comprises predetermined parameters;

modeling the sound field based on at least selected ones of the predetermined parameters;

storing the modeled sound field; and selectively creating a sound event based on the modeled sound field.

18. The method of claim 17 wherein the predetermined geometric surface is a spherical surface and the plurality of transducers are located on the spherical surface.

19. The method of claim 17 wherein the predetermined parameters comprise amplitude and directivity, and wherein the step of modeling the sound field is based on at least the amplitude and directivity of the sound field at the predetermined geometric surface.

20. The method of claim 17 wherein the sound source is a musical instrument.

21. The method of claim 17 wherein the created sound event is a substantially identical replica of the sound event that generated the modeled sound field.

22. The method of claim 17 wherein the created sound event is based on the sound event that generated the modeled sound field, but is a purposefully modified version thereof.

23. The method of claim 17 wherein the created sound event is an explosion sound event.

24. The method of claim 17 further comprising the steps of:

modeling the created sound event; and comparing the original sound event model and the created sound event model.

* * * * *